United States Patent [19]

Andrews, Jr. et al.

[11] Patent Number: 4,477,138

[45] Date of Patent: Oct. 16, 1984

[54] CARD BIASING DEVICE FOR CARD EDGE CONNECTORS

[75] Inventors: Howard W. Andrews, Jr., Hershey; Timothy B. Billman, Carlisle; Robert F. Cobaugh, Elizabethtown, all of Pa.

[73] Assignee: AMP Incorporated, Harrisburg, Pa.

[21] Appl. No.: 364,170

[22] Filed: Mar. 31, 1982

[51] Int. Cl.[3] ..... H01R 13/20

[52] U.S. Cl. ..... 339/65; 339/75 MP; 339/176 MP

[58] Field of Search ..... 339/176 MP, 65, 17 L, 339/75 MP, 91 R

[56] References Cited

U.S. PATENT DOCUMENTS

| | | | |
|---|---|---|---|
| 2,802,188 | 8/1957 | Badders | 339/17 |
| 2,925,592 | 2/1960 | Noyes | 339/91 R |
| 3,926,496 | 12/1975 | Occhipinti | 339/65 |
| 3,975,076 | 8/1976 | Shida et al. | 339/17 L |
| 4,025,147 | 5/1977 | Van Arsdale et al. | 339/176 MP |
| 4,084,874 | 4/1978 | Georgopulos | 339/75 MP |
| 4,159,861 | 7/1979 | Anhalt | 339/75 MP |
| 4,392,704 | 7/1983 | Porter | 339/176 MP |

*Primary Examiner*—John McQuade
*Assistant Examiner*—Gary F. Paumen
*Attorney, Agent, or Firm*—Allan B. Osborne

[57] ABSTRACT

The invention disclosed herein relates to a biasing means provided in one end of a card-receiving slot of a card edge connector. The biasing means includes a spring loaded wedge slidably positioned in a sloping passage at one end of the slot. The wedge includes a vertical surface which engages a side of the card as the card is inserted in the slot. The wedge moving down the sloping passage increases the slot length to accommodate the card width without exerting significant longitudinal force against the end walls of the connector. Further, the wedge cannot be moved up the passage by an uneven force being exerted on the card; accordingly, the card can only be removed from the slot in a straight line.

26 Claims, 10 Drawing Figures

CARD BIASING DEVICE FOR CARD EDGE CONNECTORS

There is described in U.S. Pat. No. 3,926,496 a card edge connector having spring means at one end of the card-receiving slot for forcibly positioning the card against the opposite end for establishing a predetermined alignment between the contact pads on the card and the contact elements arranged along one or both sides of the slot.

In this known connector, the spring means include a spring shaped in the form of a bow with downwardly extending elongated arms, one of which bears against the end wall and includes a locking tab adjacent the lower free end for locking the spring in the connector housing. The second arm is concavo-convex shaped with the convex surface providing the bearing surface against the side of the card. The free end of this second arm engages a shoulder in the floor of the slot to resiliently restrain the second arm in a direction towards the opposite end.

The disclosed spring operates to push the card against the opposite end of the slot and does not impede the insertion nor withdrawal of the card. Also, the spring per se does not care whether the card is inserted or withdrawn on a canted or crooked direction. Further, the spring is under compression continuously as long as a card is positioned in the connector.

U.S. Pat. No. 4,025,147 also discloses a card edge connector having spring means for urging the card towards the opposite end of the card-receiving slot to provide index registration. The spring means disclosed is a spring clip comprising a U-shaped portion which is received in a well separated from the card-receiving slot by a vertical wall. One leg of the U-shaped portion continues up and over the vertical wall and extends down into the card-receiving slot. The free end of the extension, which is concavo-convex shaped, engages and urges the card towards the opposite end. As with the spring disclosed in U.S. Pat. No. 3,926,496, the '147 spring is forgiving and accepts cards being inserted into the slot or withdrawn therefrom at an angle relative to the connector. Also, the '147 spring is under continued compression as long as the card is in the slot.

The present invention is intended to provide a card edge connector with a biasing device which urge the card against the opposite end of the card-receiving slot but which is not under significant longitudinally directed compression. Further, the present invention is intended to provide a card edge connector with a biasing device which prohibits the withdrawal of the card if an attempt is made to pull the card out of the connector unevenly.

A card edge connector is, according to the present invention, characterized in that a passage is provided adjacent one end of the card-receiving slot with at least one transverse wall of the passage sloping outwardly from the top to the base of the connector. Further provided is a wedge slidingly positioned in the passage with a sloping surface conformably bearing against the sloping wall and with an opposite, vertical surface for engaging a side of a card being inserted in the slot. The wedge is driven down the sloping passage by the card so as to increase the slot length to accommodate the card width. Concurrently, in cooperation with a ramp on the wedge and a coil spring, the card is urged against the far end of the slot. The wedge positions itself so that the vertical surface thereon bears against a side of the card.

Further, the sloping wall of the passage, the sloping surface of the wedge, and the vertical surface on the wedge cooperate to prohibit the withdrawal of the card from the slot except in a straight line. In other words, the card cannot move except straight out regardless of the movement forces.

For a better understanding of the invention, a description thereof will be given with reference to the accompanying drawings in which.

Figure 4:
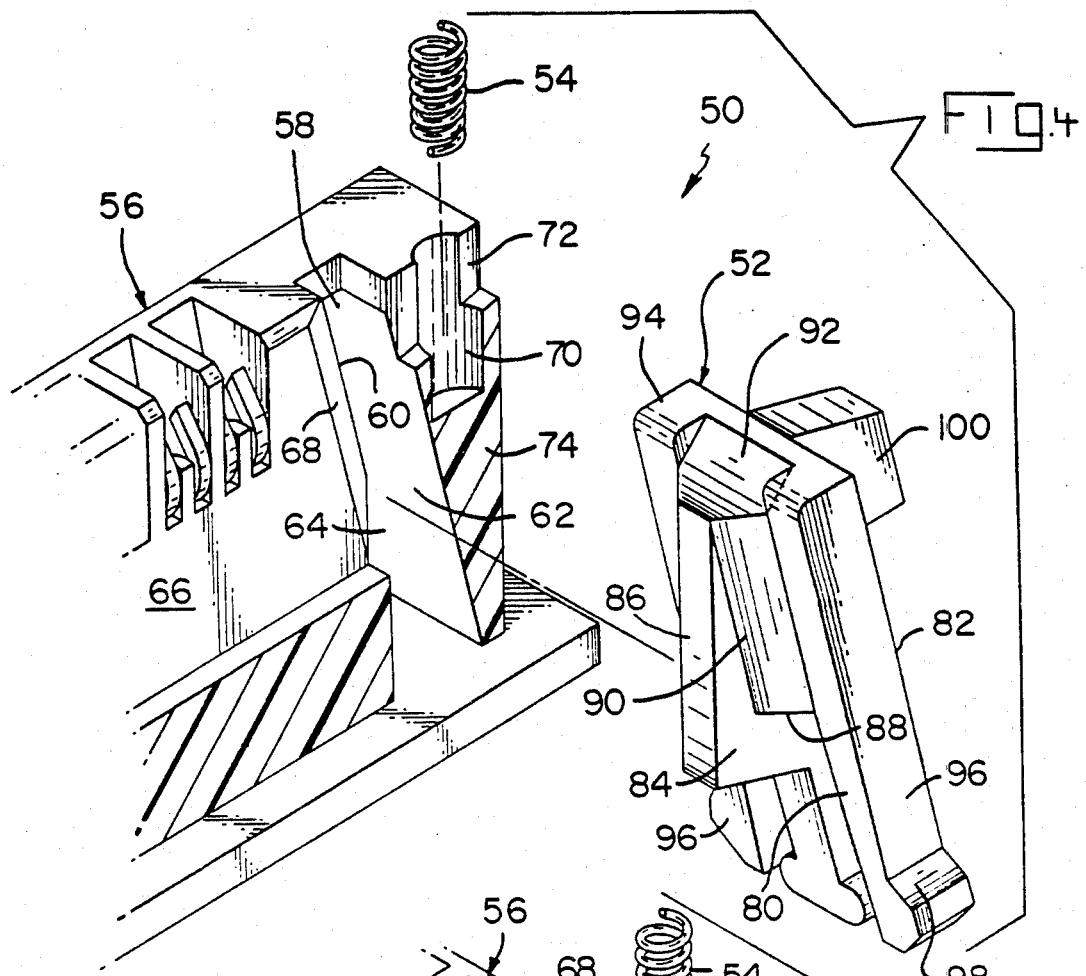
FIGS. 4 and 5 are views illustrating one embodiment of the present invention.
Figure 5:
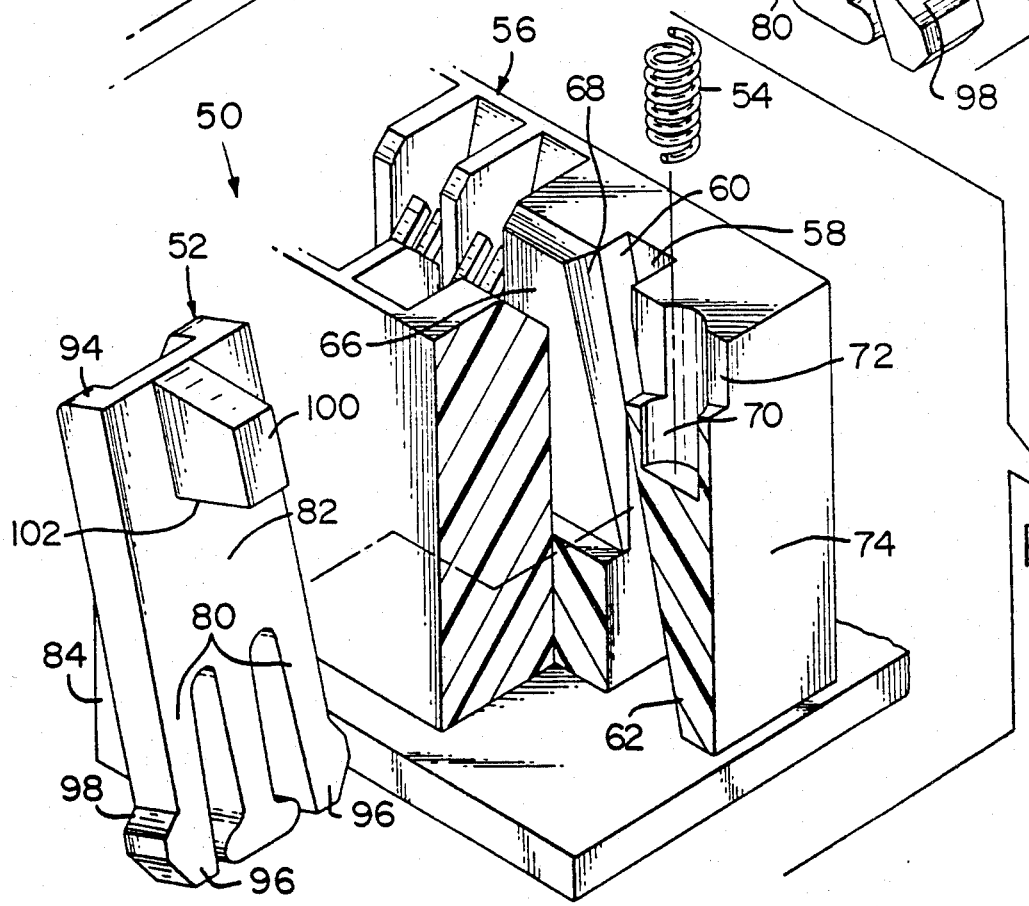
Figure 6:
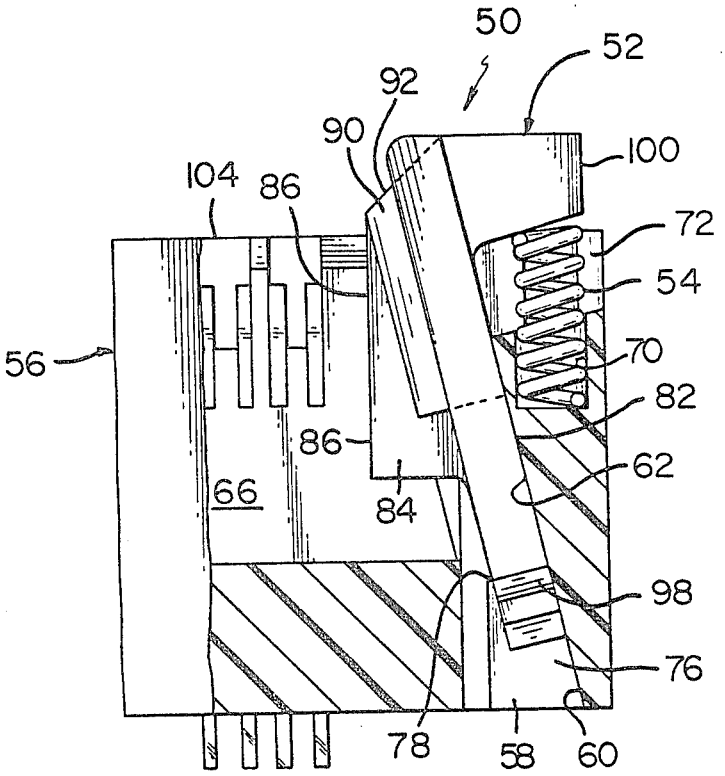
Figure 7:
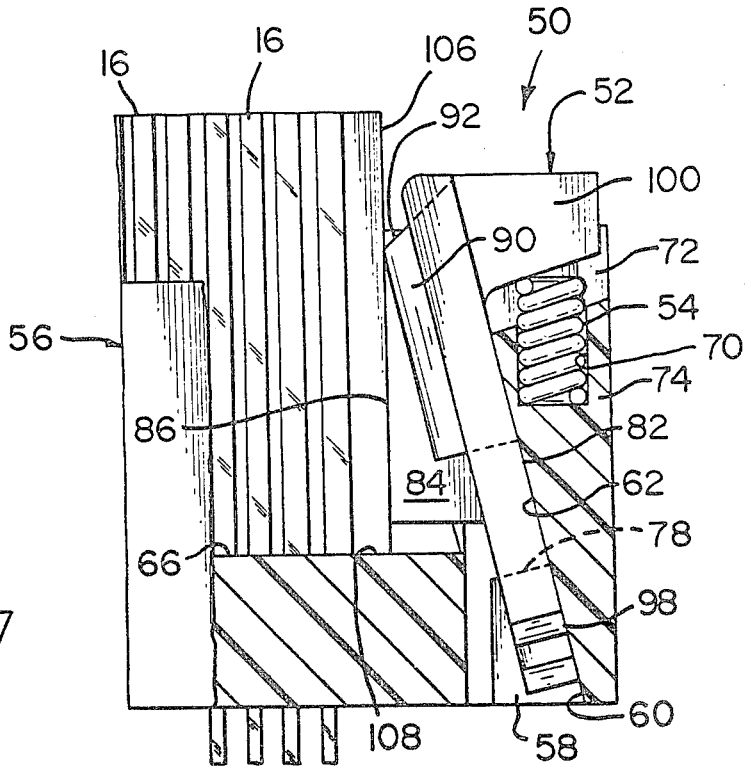
Figure 8:
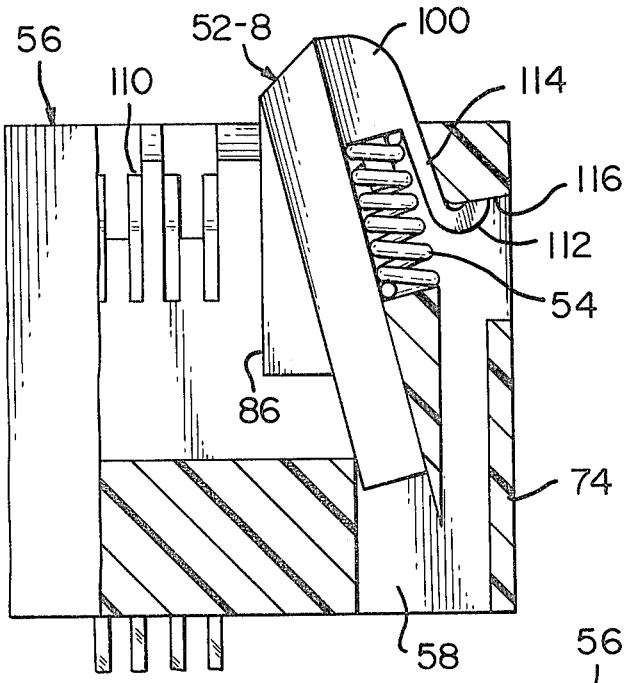
Figure 9:
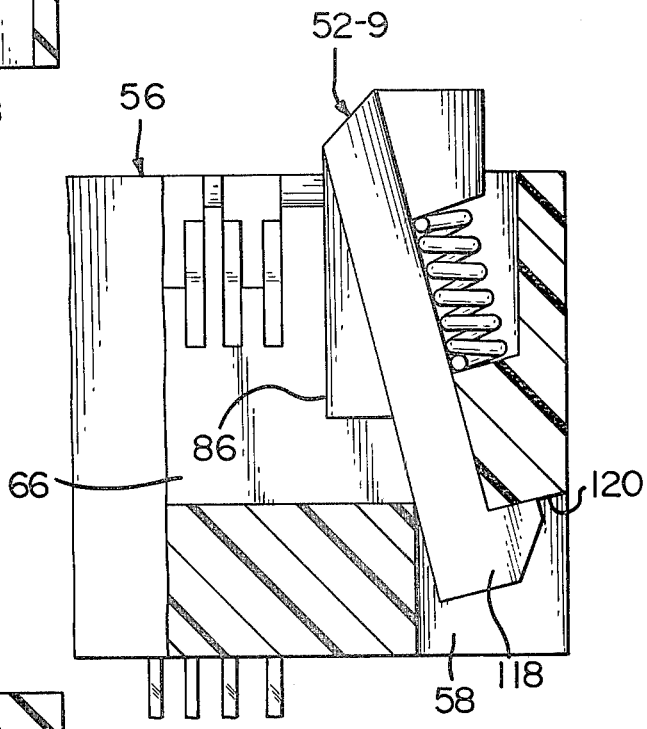
Figure 10:
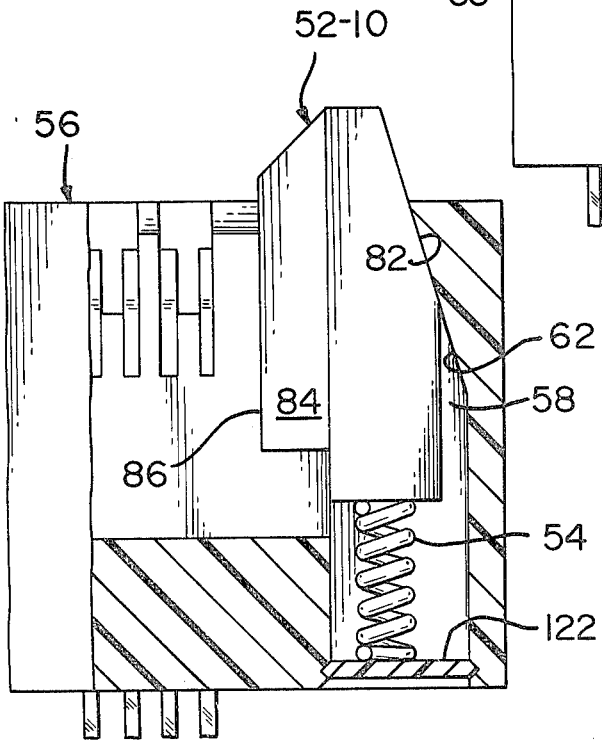

FIGS. 6 and 7 are sectional views illustrating the embodiment of FIGS. 4 and 5 in use; and FIGS. 8, 9, and 10 are views illustrating other embodiments of the present invention.

Figure 1:
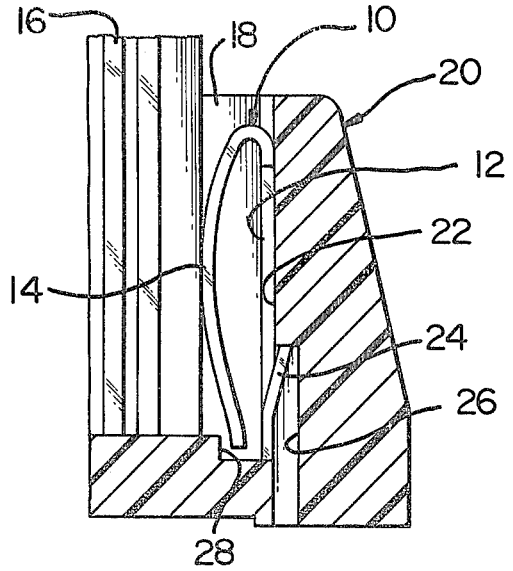
FIG. 1 PRIOR ART
FIGS. 1 and 2 are cross-sectional views illustrating the spring means disclosed in the known prior art.
Figure 2:
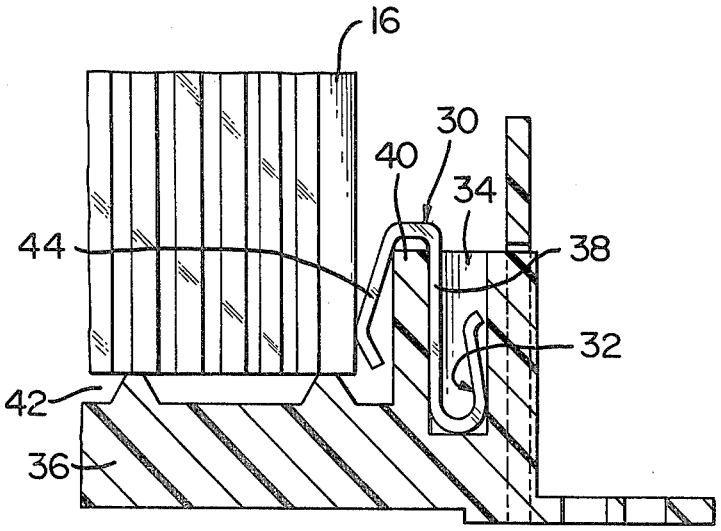
FIG. 2 PRIOR ART

FIGS. 1 and 2 illustrate the springs disclosed in U.S. Pat. Nos. 3,926,496 and 4,025,147 respectively. With regard to the drawing in FIG. 1, the spring is indicated generally by reference numeral 10. It consists of connected, elongated arms 12 and 14 with the latter bearing against the side of card 16 to urge it against the opposite end of slot 18 of connector 20. Arm 12 is positioned coextensive with the vertical wall 22 defining one end of the card-receiving slot. The free end of arm 12 includes a locking tab 24 received in notch 26 in wall 22 to restrain upward movement of the spring. The free end of arm 14 engages shoulder 28 in the absence of a card, to restrain that arm from extending further into slot 18.

Spring clip 30 shown in FIG. 2, includes a U-shaped portion 32 positioned in well 34 of connector 36. Leg 38 of the U-shaped portion extends up and over wall 40 which separates well 34 from card receiving slot 42. The free end 44 of leg 38 extends down into slot 42 with a concavo-convex surface thereon bearing against the side of card 16 to urge it against the opposite end (not shown) of slot 42.

Both springs 10 and 30 are under continuous pressure when a card is mounted in the connector. This pressure tends to permanently deform the bearing portion of the springs. Further, the vertical end walls experience the pressure which can, over a period of time, distort those walls.

Figure 3:
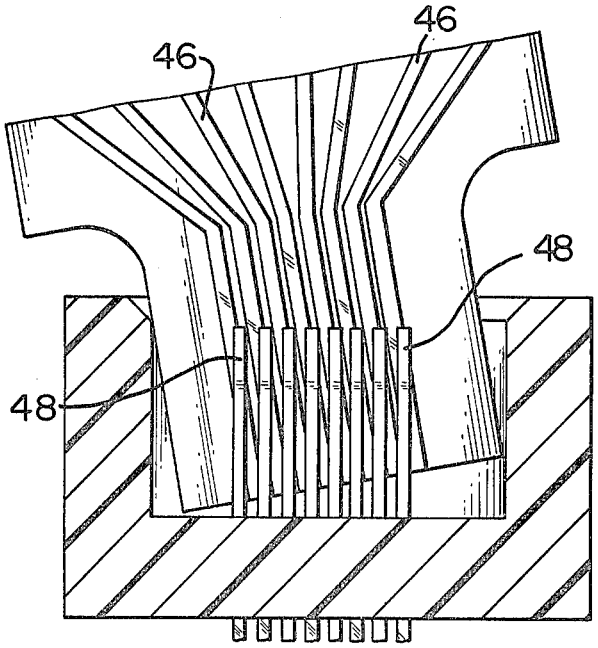
FIG. 3 is a view partly in section illustrating the problem of shorting which can occur when a card is withdrawn from a connector at an angle thereto.

The springs of the prior art will let a card be withdrawn from the card-receiving slot at an angle; i.e., one end canted relative to the other. FIG. 3 shows such a withdrawal at an exaggerated scale to demonstrate what can happen, particularly, with a card having a high density of traces 46 and a connector having a correspondingly high density of contact elements 48. As the card is withdrawn at an angle, as shown in the drawing, a contact element 48 can engage and electrically interconnect more than one trace 46 simultaneously. This, of course, can cause considerable damage to the electronic devices (not shown) associated with the card.

The present invention is intended to overcome the above mentioned and other problems.

Biasing device 50, shown in FIGS. 4 through 7, include wedge 52, coil spring 54, and the following structural features provided at one end of connector 56 to cooperate with the wedge and spring: sloping passage 58 defined substantially by transverse front sloping wall 60 and transverse rear sloping wall 62, opening 64 between card-receiving slot 66 and passage 58 through front sloping wall 60, longitudinally beveled surface 68 on the two side walls defining opening 64, a coil spring-receiving aperture 70 and a downwardly extending notch 72 in the near end wall 74 of connector 56. The notch intersects passage 58 and extends horizontally through aperture 70. In addition, side walls 76 of passage 58 provide downwardly facing shoulders 78 (FIGS. 6 and 7). The passage slopes obliquely downwardly towards the connector end wall 74; i.e., away from slot 66.

Wedge 52 slides up and down in passage 58 with its front and rear surfaces, 80 and 82 respectively, being conformable to sloping walls 60 and 62. The dimensions permit easy sliding of the wedge in the passage. A nose-like portion 84 extends forwardly from front surface 80 of the wedge. A flat, slot-facing surface 86 is provided on portion 84. The nose-like portion is strengthened against breakage by fillets 88 which provide angled or oblique surfaces 90. Ramp 92 is located on top of portion 84 at the top 94 of wedge 52. The ramp is at an angle of forty-five degrees relative to the horizontal plane.

The bottom of wedge 52 is slotted to define flexible fingers 96, one on each side. An upwardly facing, curved or beveled (as shown) shoulder 98 is provided at the free end and on the outside surfaces of the fingers to retain the wedge in the passage in cooperation with shoulders 78.

FIG. 4 shows the front of wedge 52 and FIG. 5, to which attention is now directed, shows the back of the wedge. An arm 100 projects rearwardly from rear surface 82 adjacent top 94 of the wedge. The downwardly facing surface 102 engages one end of coil spring 54 when positioned in aperture 70.

FIG. 5 also provides a view of passage 58 and supporting structure from a different direction.

FIG. 6 shows wedge 52 positioned in passage 58 in connector 56. Portion 84 projects through opening 64 into card-receiving slot 66. Surface 86 on portion 84 is vertical. Sloping walls 60, 62 and wedge surfaces 80, 82 are at an angle to the vertical. The importance of the angle is noted below.

Spring 54 is positioned in aperture 70 and is pushing up against arm 100. Thus, wedge 52 is at the upper most position in passage 58, shoulders 98 abutting shoulders 78 to prevent further upward travel. Ramp 92 and part of surface 86 on portion 84 is above the top surface 104 of connector 56.

Sloping walls 60 and 62 conformably mate with front and rear surfaces 80 and 82, respectively on the wedge. Surfaces 90 provided by fillets 88 slides along longitudinally beveled surfaces 68 which define the sides of opening 64. The dimensions are such that the wedge slides easily in passage 58 but without movement in the direction perpendicular to the sloping walls and wedge surfaces. (Some movement, as a practical matter, will occur due to required clearances. Such movement is very slight, however).

The sloping walls 60, 62 of passage 58 and surfaces 80, 82 on wedge 52 are designed to be at an angle of from seven to thirty degrees relative to the vertical. It has been determined that if the angle is less than seven degrees, the wedge would tend to lock or bind up and prevent a card from being withdrawn from the slot. An analogous case is the "Chinese finger" tube. It has also been determined that if the angle is greater than thirty degrees, any longitudinal force exerted against the wedge by the card being withdrawn, no matter how slight, would push the wedge down the passage and thus provide room for the card to move longitudinally or let it tilt; i.e., the FIG. 3 condition.

A critical parameter in determining the angle is the coefficient of friction for the materials used in the connector housing, wedge, and card. The basic premise involved is that the frictional force between sloping wall 62 (of passage 58) and rear surface 82 (of wedge 52) must be greater than the frictional force between card side 106 and surface 86 (of the nose-like portion 84 of wedge 52); in other words:

$$F_1 \text{ cosine } \theta > F_2$$

where:

$F_1$ = The force resulting from a longitudinal force and the coefficient of friction between wall 62 and surface 82;

$F_2$ = The force resulting from a longitudinal force and the coefficient of friction between card side 106 and surface 86; and $\theta$ = the angle of the walls 60, 62 and surfaces 80, 82, when the wedge is positioned in the passage, as they deviate from the vertical.

Once the coefficients of friction are ascertained, the optimum angle can be determined quite readily. Other formulas, well known to those skilled in the art, can also be used to determine the angle.

Where the connector housing is made from VALOX, a glass-filled nylon made by General Electric Company, the wedge from NORYL, a polyphenylene oxide also made by General Electric Company and the card is fiber glass, the optimum angle range is from about nine to about fifteen degrees and the preferred angle is nine degrees.

The operation of biasing device 50 is as follows: a card 16 of minimum width will just fit into the slot, it's length being the distance between the slots far left end (not shown) and surface 86 on wedge 52. If, upon being inserted, the cards' far left side (not shown) is not against the far left end of the slot, the lower right-hand corner 108 (FIG. 7) on card 16 will bear against ramp 92 on the wedge. As the card is pushed further into the slot, the wedge is moved down passage 58 and arm 100, moving down notch 72, compresses coil spring 54. At some point, the compressive force of the spring and the ramp angle cooperate to exert a longitudinal force against the card so that it moves off the ramp and against the far left end of slot 66. The wedge, under the influence of the spring, will move back up the passage to where it engages side 106 of the card. When the card is fully in slot 66, a slight compressive force in the longitudinal direction; i.e., parallel to slot 66, is exerted against passage wall 62 and card 16 by the wedge through the compressed coiled spring urging the wedge up the passage. If the card is initially positioned against the far left end of the slot, the card will enter the slot without necessarily moving the wedge.

Referring back to FIG. 6 and imagining card 16 in slot 66, the above condition is obtained. If an attempt is made to withdraw the card in a manner other than straight out, a longitudinal force exerted by the card against the wedge would not be able to move the wedge in passage 58. Accordingly, the card cannot be withdrawn at an angle to expose the traces thereon to the FIG. 3 condition.

If the width of card 16 is greater than the FIG. 6 slot length, the lower right-hand corner 108 of card 16 strikes ramp 92. As the card is pushed further in, the wedge moves down and outwardly, increasing the length of the slot. When the length is increased sufficiently, the corner slips off the ramp and the card slides past the now substantially stationary wedge. As the card and wedge is moving down, the wedge will be exerting the longitudinal force noted above to urge the card against the far left-hand side of slot 66.

It is important to note that the wedge will have been moved before the card reaches contact elements 110 (FIGS. 4, 5, and 6). The card is thus properly positioned in the slot before it is required to apply the high insertion forces necessary to force the card between the contact elements. When the card is fully inserted, it cannot move longitudinally against wedge 52 as noted above. Importantly, the card is being held securely in the slot without a longitudinal force being exerted against the wedge and end wall 74 of connector 56 in any significant amount.

Even with the wedge pushed down passage 58 as shown in FIG. 7, the card cannot be withdrawn from slot 66 except in a straight line. The wedge cannot move outwardly, and because there is no downward force, it cannot be moved down (and thus out). Accordingly, the card cannot be moved longitudinally or tilted because the length of slot 66 cannot be increased.

As the card is withdrawn, wedge 52 may move upwardly but only slightly until the friction between sloping wall 62 and rear surface 82 impedes further travel.

FIGS. 8, 9 and 10 are alternative embodiments of the present invention. In FIG. 8, upward travel of wedge 52-8 is restrained by means of hook 112 located on a downward extension 114 on arm 100 and a downwardly facing shoulder 116 on end wall 74 of the connector housing. This modification eliminates the need to provide fingers 96 on the lower end of the wedge.

Wedge 52-9 is modified by providing a lip 118 on the middle finger (between fingers 96, FIG. 5) adjacent the lower end. The lip cooperates with a downwardly facing shoulder 120 to limit upward travel. Shoulders 98 on fingers 96 are not required.

The embodiment disclosed in FIG. 10 closes off the lower end of passage 58 and positions coil spring 54 between the bottom of wedge 52-10 and floor 122 of passage 58. While the spring is shown being positioned vertical, the wedge and floor 122 can be easily modified so that the spring is at the same angle as sloping wall 62. Further, the front sloping wall 60 of the passage and front surface 80 on wedge 52 has been deleted.

In summary, the invention disclosed herein teaches a card edge connector with a biasing device at one end of a card-receiving slot which increases the length of the slot so that cards of differing widths can be received therein without a substantial longitudinal force being applied to the end walls of the connector. Further, the biasing device urges the card against the opposite end wall for proper index registration between the card traces and connector contact elements. Additionally, the biasing device restricts card withdrawal to a straight line directly away from the connector.

We claim:

1. A card edge connector (56) having a card biasing device (50) at one end of a longitudinal, card-receiving slot (66), characterized in that the biasing device (50) comprises a passage (58) located adjacent one end of the card-receiving slot (66) and having a transverse rear wall (62) sloping obliquely downwardly towards a near end wall (74) of the connector (56) and a wedge (52) slideably positioned in the passage (58) and having a sloping surface (82) conformably sliding along the sloping transverse wall (82) of the passage (58) and a vertical surface (86) opposite the sloping surface (82) and facing into the slot (66) for abutting engagement with a card (16) which may be inserted into the slot (66) and means (54) for biasing the wedge (52) upwardly in the passage (58).

2. A card edge connector of claim 1 characterized in that the means (54) for biasing the wedge (52) upwardly in the passage (58) includes a coil spring (54).

3. A card edge connector of claim 2 characterized in that the coil spring (54) is located in an aperture (70) in the near end wall (74) of the connector (56) and the wedge (52) includes an arm (100) for engaging the coil spring (54).

4. A card edge connector of claim 2 characterized in that the coil spring (54) is located between the wedge (52) and a floor (122) of passage (58).

5. A card edge connector of claim 2 characterized in that the passage (58) further includes a transverse front sloping wall (60) with an opening (64) extending through the transverse front sloping wall (60) from the card-receiving slot (66).

6. A card edge connector of claim 5 characterized in that the vertical surface (86) is located on a nose-like portion (84) on the wedge (52) and with the nose-like portion (84) projecting through the opening (64).

7. A card edge connector of claim 2 characterized in that a ramp (92) extends from the top (94) of the wedge (52) to the top of the vertical surface (86).

8. A card edge connector of claim 1 wherein the transverse rear wall (62) slopes at an angle of from about seven degrees relative to the vertical to about thirty degrees.

9. A card edge connector of claim 1 wherein the transverse rear wall (62) slopes at an angle of from about nine degrees relative to the vertical to about fifteen degrees.

10. A card edge connector (56) having a biasing device (50) at one end of a longitudinal, card-receiving slot (66), characterized in that the biasing device (50) comprises a passage (58) located adjacent one end of the card-receiving slot (66) and having a transverse rear wall (62) sloping obliquely downwardly towards a near end wall (74) of the connector (56) and a wedge (52) slideably positioned in the passage (58) and having a sloping surface (82) conformably sliding along the sloping transverse wall (62) of the passage (58) and a surface (86) opposite the sloping surface (82) and facing into the slot (66) for abutting engagement with a card (16) which may be inserted into the slot (66) and further including means (54) for biasing the wedge (52) upwardly in the passage (58).

11. A card edge connector of claim 10 characterized in that the means (54) for biasing the wedge (52) upwardly in the passage (58) includes a coil spring (54).

12. A card edge connector of claim 11 characterized in that the coil spring (54) is located in an aperture (70) in the near end wall (74) of the connector (56) and the wedge (52) includes an arm (100) for engaging the coil spring (54).

13. A card edge connector of claim 11 characterized in that the coil spring (54) is located between the wedge (52) and a floor (122) of passage (58).

14. A card edge connector of claim 10 characterized in that the passage (58) further includes a transverse front sloping wall (60) with an opening (64) extending through the transverse front sloping wall (60) from the card-receiving slot (66).

15. A card edge connector of claim 14 characterized in that the surface (86) is located on a nose-like portion (84) on the wedge (52) and with the nose-like portion (84) projecting through the opening (64).

16. A card edge connector of claim 10 wherein the transverse wall (62) slopes at an angle of from about seven degrees relative to the vertical to about thirty degrees.

17. A card edge connector of claim 10 wherein the transverse wall (62) slopes at an angle of from about nine degrees relative to the vertical to about fifteen degrees.

18. Card biasing device for card edge connectors having a card slot, the device comprising:

a. a passage adjacent one end of the card slot and extending obliquely downwardly in a direction away from the slot;

b. an opening between the card slot and passage; and c. a wedge slideably positioned and biased upwardly in the passage and having a vertical surface thereon extending thru the opening into the card slot, said surface being adapted to abuttingly engage a side of a card being inserted into the slot.

19. The card biasing device of claim 18 wherein a coil spring biases the wedge.

20. The card biasing device of claim 19 wherein the coil spring is located in an aperture adjacent the passage and the wedge includes an arm for engaging the coil spring.

21. The card biasing device of claim 19 wherein the coil spring is located between the wedge and a floor of the passage.

22. The card biasing device of claim 18 wherein the passage includes transverse sloping walls.

23. The card biasing device of claim 22 wherein the transverse walls slopes at an angle of from about seven degrees relative to the vertical to about thirty degrees.

24. The card biasing device of claim 22 wherein the transverse walls slope at an angle of from about nine degrees relative to the vertical to about fifteen degree.

25. The card biasing device of claim 18 wherein the vertical surface is on a nose-like portion on the wedge and with the nose-like portion projecting thru the opening.

26. A card biasing device of claim 18 wherein a ramp extends from the top of the wedge to the top of the vertical surface.

* * * * *

UNITED STATES PATENT OFFICE

CERTIFICATE OF CORRECTION

Patent No. 4,477,138 Dated October 16, 1984

Inventor(s) Howard W. Andrews, Jr., Timothy B. Billman, Robert F. Cobaugh

It is certified that error appears in the above-identified patent and that said Letters Patent are hereby corrected as shown below:

Column 6, line 7, change "(82)" to ---(62)---.

Column 8, line 20, change "degree" to ---degrees---.

Signed and Sealed this

*Twenty-fifth* Day of *June 1985*

[SEAL]

*Attest:*

DONALD J. QUIGG

*Attesting Officer* *Acting Commissioner of Patents and Trademarks*